US006685297B2

(12) United States Patent
Butterfield et al.

(10) Patent No.: US 6,685,297 B2
(45) Date of Patent: Feb. 3, 2004

(54) PRINT HEAD ALIGNMENT METHOD, TEST PATTERN USED IN THE METHOD, AND A SYSTEM THEREOF

(75) Inventors: Patricia G. Butterfield, Ontario, NY (US); Steven R. Moore, Rochester, NY (US); Richard H. Tuhro, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/961,556

(22) Filed: Sep. 24, 2001

(65) Prior Publication Data

US 2003/0058294 A1 Mar. 27, 2003

(51) Int. Cl.[7] ..... B41J 29/393
(52) U.S. Cl. ..... 347/19
(58) Field of Search ..... 347/19, 14; 400/74

(56) References Cited

U.S. PATENT DOCUMENTS 4,878,063 A * 10/1989 Katerberg ..... 347/19
5,250,956 A * 10/1993 Haselby et al. ..... 347/19
5,448,269 A 9/1995 Beauchamp et al. ..... 347/19
5,451,990 A 9/1995 Sorenson et al. ..... 347/19
5,600,350 A 2/1997 Cobbs et al. ..... 347/19
5,835,108 A 11/1998 Beauchamp et al. ..... 347/19
6,076,915 A * 6/2000 Gast et al. ..... 347/19
6,109,722 A * 8/2000 Underwood et al. ..... 347/19
6,164,749 A * 12/2000 Williams ..... 347/19
6,290,320 B1 9/2001 Beauchamp et al. ..... 347/19
6,464,321 B1 * 10/2002 Nunokawa ..... 347/19
6,474,765 B2 11/2002 Beauchamp ..... 347/14

* cited by examiner

*Primary Examiner*—Stephen Meier
*Assistant Examiner*—Julian D. Huffman
(74) *Attorney, Agent, or Firm*—Nixon Peabody LLP

(57) ABSTRACT

A method of aligning one or more print heads in a print head unit and a system thereof. A first pattern of first symbols is printed on a print medium and a second pattern of second symbols is printed with a second print head on the print medium with one or more print heads in a manner to superpose the second pattern on the first pattern and so that at least some of the first symbols obscure a corresponding one of the second symbols. At least some of the second symbols are offset from a regular pattern and the offset distances are recorded. A user can designate at least one of the second symbols that is obscured by a corresponding one of the first symbols and the offset distance corresponding to the designated second symbol is used as an offset parameter for the second print head with respect to the first print head.

30 Claims, 3 Drawing Sheets

PRINT HEAD ALIGNMENT METHOD, TEST PATTERN USED IN THE METHOD, AND A SYSTEM THEREOF

BACKGROUND OF THE INVENTION

The subject invention relates generally to alignment of printheads and more specifically to a method for aligning one or more printheads, such as color and black printheads, which permits accurate subjective alignment determination.

Various technologies are well known for effecting printing on media. For example, laser printers, heat sublimation printers, inkjet printers, thermal printers, and the like, are well known. Color printers often have a plurality of print heads. For example, a typical color inkjet printer has four inkjet printheads, one that utilizes black ink, and three that utilize colored inks, such as magenta, cyan and yellow. The colors from the three color printheads are mixed to obtain any desired color.

A typical raster or matrix type printhead is capable of printing a plurality of rows of dots in a single scan across the print media. Each printhead typically includes a plurality of printing elements (e.g., ink jet nozzles) displaced relative to each other which allow printing of a plurality of rows of dots. After one scan, the media can be advanced by the number of rows that the each printhead is capable of printing in one scan.

A consideration with multiple printhead printers is print quality degradation, such as poor color registration, as a result of printhead mechanical alignment (e.g., the uncertainty of printhead to printhead positioning, and drop velocity differences between printheads). Mechanical tolerances of the printhead to print media spacing also contribute to poor registration. Factory compensation for each printer manufactured and/or tight manufacturing tolerance control would address some of the factors contributing to printhead misalignment, but would be extremely difficult and expensive. Moreover, manufacturing tolerance control might not be able to address the alignment effects of aging and temperature. Alignment of printheads is also a concern after manufacturing by customers and other end users of these printers. Accordingly, methods of "soft alignment" have been developed which permit printhead alignment selection using software. In particular, the timing of ink ejection and ejector selection is adjusted to create proper alignment of printed dots on the print media. The term "alignment" as used herein refers to correction of offsets due to mechanical tolerances, ink ejection direction and velocity, and other factors contributing to poor registration between data printed by printheads. One known technique of alignment involves printing to test pattern of vertical and horizontal lines corresponding to various incremental offsets of the printheads. The user then selects portions of the test pattern in which the horizontal and vertical lines most closely represent a straight unbroken line. For example, U.S. Pat. No. 4,878,063, which is herein incorporated by reference, discloses such a method.

However, the determination of which lines on the test pattern most closely represent a straight unbroken line is highly subjective and often difficult for a user to make. Of course any errors in the determination result in poor offset data being used for soft alignment and thus poor registration of colors.

SUMMARY OF THE INVENTION

A first aspect of the invention is a method of aligning one or more print heads in a print head unit. The method comprises printing a first pattern of first symbols on a print medium and printing a second pattern of second symbols with one or more print heads on the print medium in a manner to superpose the second pattern on the first pattern and so that at least some of the first symbols obscure a corresponding one of the second symbols. At least some of the second symbols are offset from a regular pattern and the offset distances are recorded. A user designates at least one of the second symbols that is obscured by a corresponding one of the first symbols and an offset distance corresponding to the designated second symbol is used as an offset parameter for aligning one of the one or more print heads.

A second aspect of the invention is a method of creating a test print for use in aligning one or more print heads in a print head unit. The method comprises printing a first pattern of first symbols on a print medium and printing a second pattern of second symbols on the print medium in a manner to superpose the second pattern on the first pattern so that at least some of the first symbols obscure a corresponding one of the second symbols. At least some of the second symbols are offset from a regular pattern.

A third aspect of the invention is a system for aligning one or more print heads in a print head unit including one or more print heads and a controller. The one or more print heads print a first pattern of first symbols on a print medium and print a second pattern of second symbols on the print medium in a manner to superpose the second pattern on the first pattern and so that at least some of the first symbols obscure at least portions of a corresponding one of the second symbols. The controller records an offset distance of the second pattern of symbols from a regular pattern, designates at least one of the second symbols that is most completely obscured by a corresponding one of the first symbols, and uses the offset distance corresponding to the designated second symbol as an offset parameter for aligning one of the one or more print heads.

DETAILED DESCRIPTION OF THE INVENTION

Figure 1:
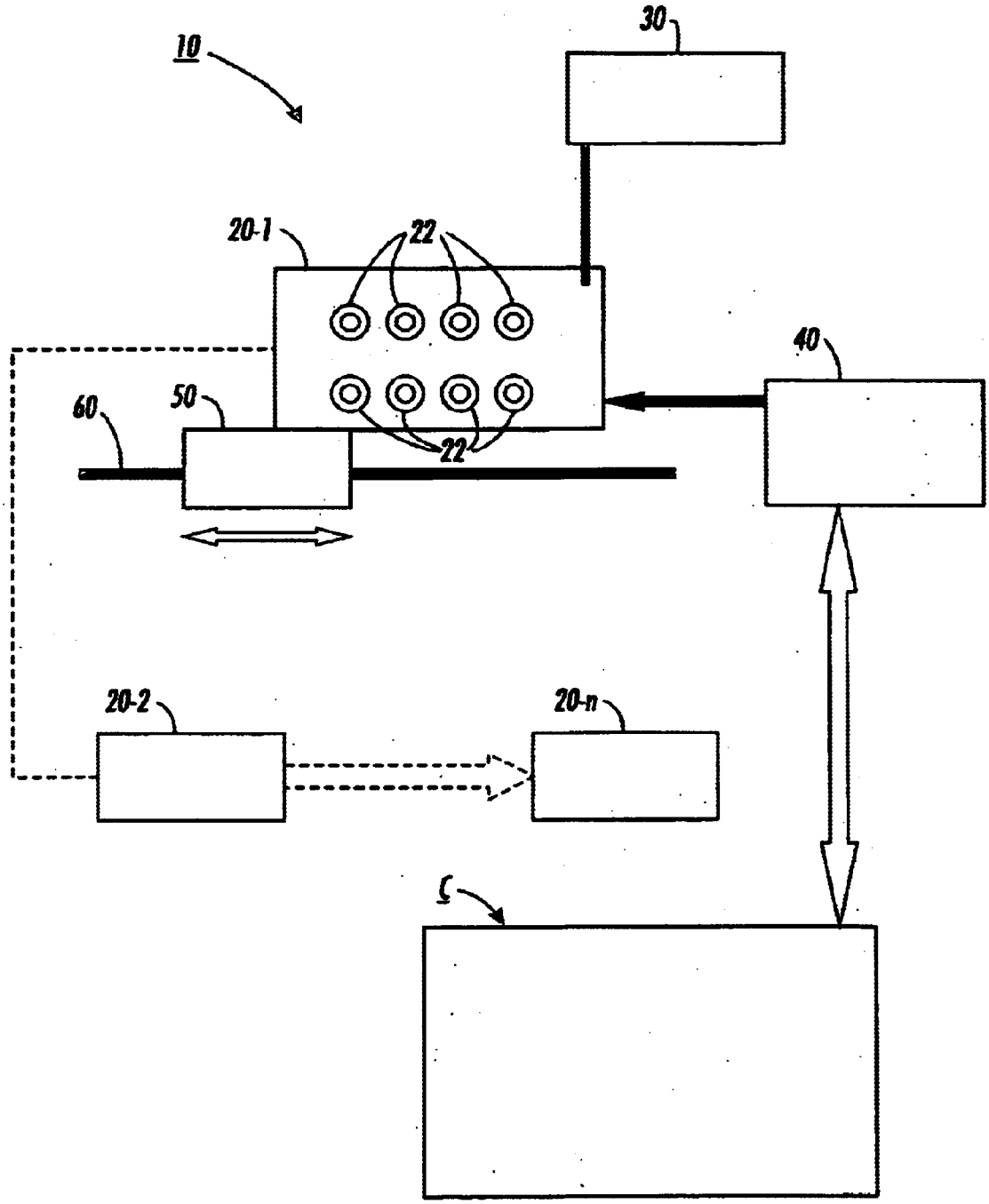
FIG. 1 is a schematic illustration of a printing apparatus which can be used in accordance with an embodiment of the invention.

FIG. 1 illustrates printing apparatus 10 which can be used in accordance with an embodiment of the invention. Printing apparatus 10 is an ink jet apparatus. However, the invention can be accomplished in connection with any type of print apparatus having plural printheads, such as a laser printer, a LED printer, a thermal printer, or the like. Printing apparatus 10 includes printhead 20(1) having a plurality print elements in the form of ink ejection nozzles 22 and corresponding ejection elements. Ink supply 30 is coupled to ejection nozzles 22 via ink channels formed in printhead 20. For example, print head 20(1) can be formed of a silicon substrate and ejection nozzles 22 and the ink channels can be formed using known semiconductor fabrication techniques. An ejection element, such as a heater, a piezoelectric device, or the like is associated with each ejection nozzle 22 to eject ink in a known manner.

Printhead 20(1) is mounted on carriage 50 which is movable along rail 60 by appropriate motive devices and linkages in a conventional manner to permit printhead 20(1) to scan across print media. Controller 40 is operatively coupled to print head 20(1) and carriage 50 to control ejection of ink from ejection nozzles 22, movement of carriage 50 along rail 60, movement of print media, and the relative timing between these operations to cause printhead 20(1) to print a desired image on a print medium, such as paper, in a known manner. Controller 40 can be a microprocessor based device programmed in a desired manner. For example, controller 40 can be a Field Programmable Gate Array (FPGA). Printing apparatus 10 also includes printheads 20(2) through **20(*n*) coupled to carriage 50 and controller 40 as illustrated schematically. For example, each printhead 20(1) through 20(*n*) can be coupled to an ink supply of a different color to accomplish multi-color printing in a known manner. Each printhead 20(2) through 20(*n*) can be mounted on carriage 50, controlled by controller 40, and otherwise can be similar in construction and function to printhead 20(1) described above. The activation, timing and selection of ejection nozzles 22 can be varied by controller 40 to accomplish soft alignment of print heads 20(1) through 20(*n*) with respect to one another. Of course, it is desirable to have a mechanism by which a user can provide input to controller 40 to adjust the control algorithm thereof in a manner which provides for proper soft alignment of printheads 20(1) through 20(*n*). In this particular embodiment, the controller 40** comprises a processor coupled to a memory in which programmed instructions for a method for aligning print heads in a print head unit in accordance with the present invention are stored for execution by the processor, although the controller could comprise other components.

Figure 2:
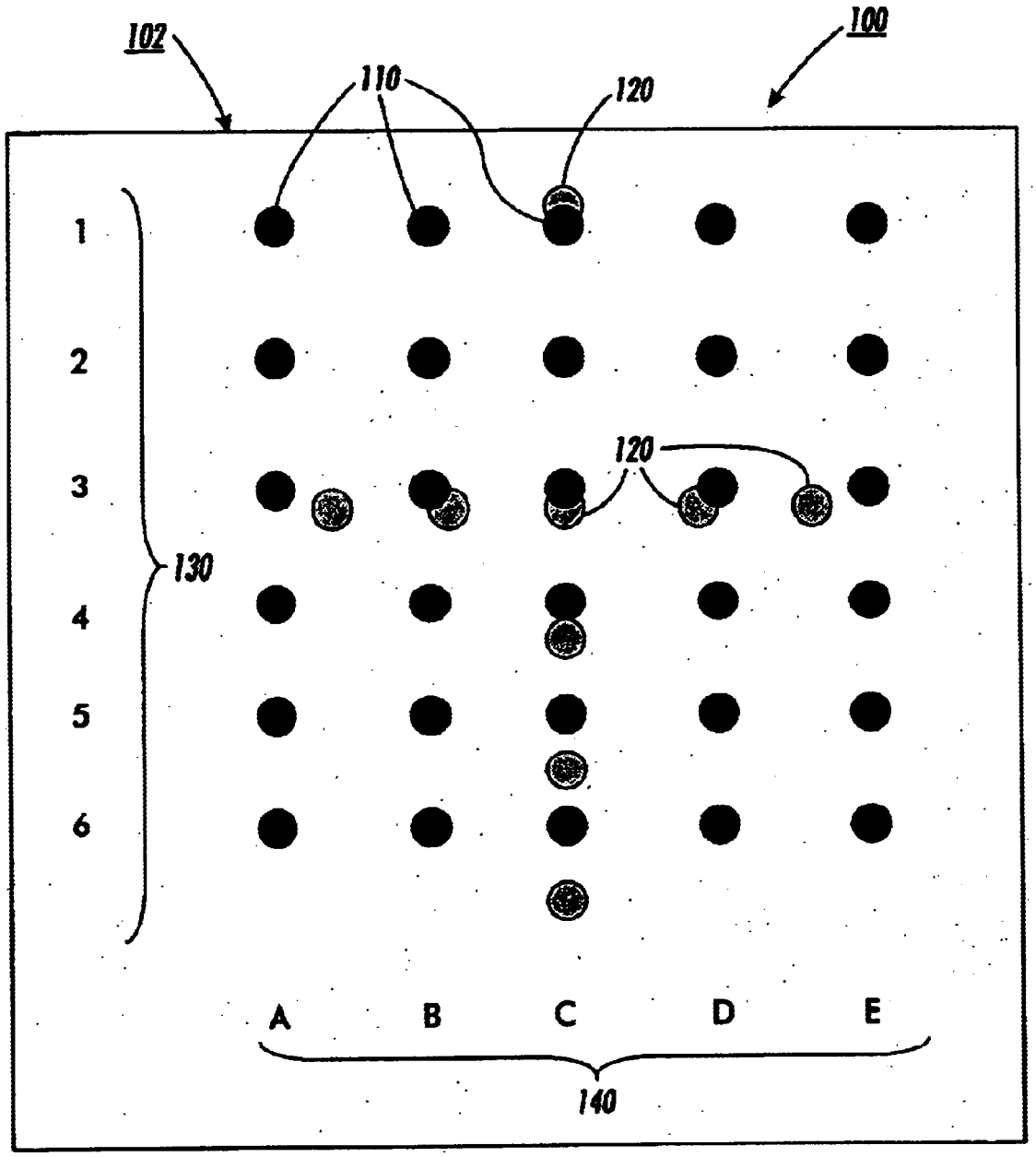
FIG. 2 is a test pattern in accordance with an embodiment of the invention.
Figure 3:
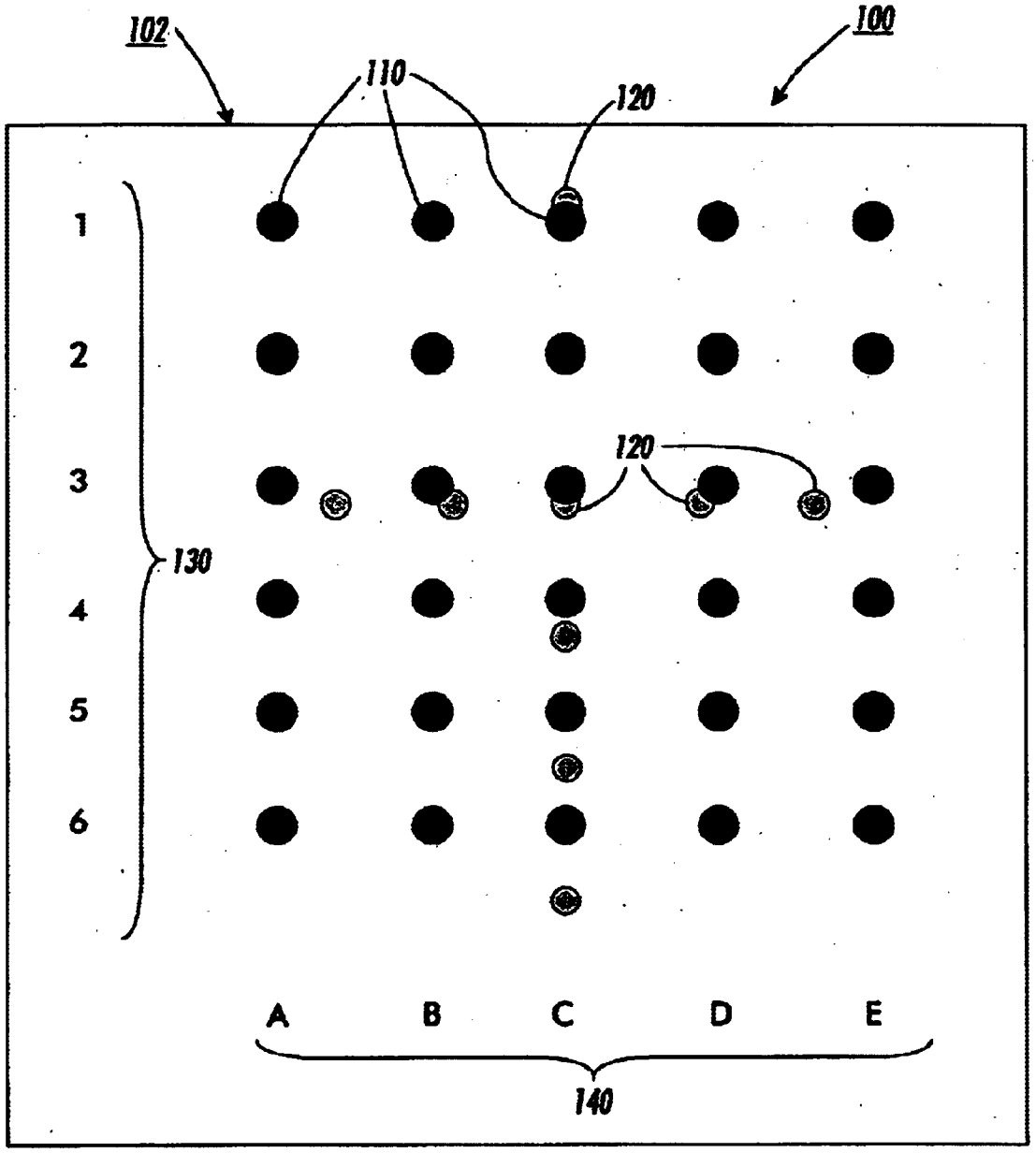
FIG. 3 is a test pattern in accordance with an embodiment of the invention.

Referring to FIG. 2 an alignment test pattern 100 printed by printing apparatus 10 for assisting the operator in providing input to controller 40 to accomplish soft alignment of printheads 20(1) through **20(*n*) is illustrated, although the method can be used on a single print head. Test pattern 100 takes advantage of the generally high ability of the human eye to detect and distinguish color and contrast. a2**

As illustrated in FIG. 2, test pattern 100 is printed on print media 102, such as paper, by printing apparatus 10 and includes first symbols 110 (only some of which are denoted by a reference numeral) of a first color, black in the embodiment, and second symbols 120 (only some of which are denoted by a reference numeral) of a second color. First symbols 110 in this particular example are printed by a first printhead, such as printhead 20(1), and second symbols 120 are printed by a second printhead, such as printhead 20(2). First symbols 110 are printed in an array having uniform spacing, and may be printed in a grid pattern. In other words, each first symbol 110 is equidistant from other first symbols 110, at least along one axis. In contrast, second symbols 120 are printed in an array in which at least some of second symbols 120 are varied slightly, i.e. are offset, in the horizontal and/or vertical direction. First symbols 110 and second symbols 120 are printed under control of controller 40 in response to a print signal generated by a print driver of a computer C or other device coupled to print apparatus 10 in a known manner. The vertical and/or horizontal offset of each second symbol 120 is recorded in controller 40 or in the computer C or other device used to drive print apparatus 10. In this embodiment, there is only one row of second symbols 120 in the horizontal direction and one column of second symbols 120 in the vertical direction. However, second symbols 120 can be in plural rows and columns similar to first symbols 110. Similarly, first symbols 110 can be printed in only one row and one column. Alternatively, the symbols can be printed in any pattern, such as to define concentric circles or other shapes.

Scales 130 and 140 are provided as indicia to permit the user to designate a particular one of first symbols 110 by designating a row number and a column letter. After printing test pattern 102, the user is asked to input the row and column number in which the second symbol 120 is completely or most completely obscured by a corresponding first symbol 110. This request and the requisite input can be accomplished through the operator interface of computer C or other device use to drive print apparatus 10 in a known manner. It can be seen that the first symbol 110 that is at row 2, column C most completely obscures the corresponding second symbol 120. Accordingly, the offset of second symbol 120 corresponding to row 2, column C is appropriate for soft alignment of printheads 20(1) and 20(2). Subsequently, controller 40 can use the indicated offset as the offset parameter for printhead 20(2) with respect to printhead 20(1) in this example. In another embodiment, the controller 40 can use the offset parameter to align a single print head 20 which was used to print the first and second symbols 110 and 120. In embodiments of the present invention, the first and second symbols 110 and 120 may be printed simultaneously.

Other print heads can be aligned in a similar manner by printing a separate test pattern or by including third symbols, etc., in test pattern 102 and designating a position for each symbol in a similar manner. The symbols can be differentiated by shape, color, pattern, or the like. The first symbols can be slightly larger than the second symbols. The symbols can be of any shape or size and can be printed in any pattern. The use of substantially the same pattern for the symbols, or in other words a repetitive pattern, is helpful in assisting an observer in picking out the area where one pattern obscures another pattern. Any indicia can be used to designate portions of the test pattern.

The invention has been described through an embodiment. However, various modifications can be made without departing from the scope of the invention as defined by the appended claims and legal equivalents.

What is claimed:

1. A method of aligning one or more print heads in a print head unit, the method comprising:

printing a first pattern of first symbols on a first region of a print medium and printing a second pattern of second symbols on the first region of the print medium with one or more print heads in a manner to superpose the second pattern on the first pattern;

offsetting at least one of the second symbols from corresponding first symbol in both a first offset direction and a second offset direction;

recording a first offset distance for the first offset direction and a second offset distance for the second offset direction of each offset second symbol;

designating at least one of the second symbols that is most completely obscured by a corresponding one of the first symbols; and using a first offset distance and a second offset distance corresponding to the designated second symbol as offset parameters for aligning one of the one or more print heads.

2. A method as recited in claim 1 wherein the printing a second pattern of second symbols is accomplished simultaneously with the printing a first pattern of first symbols.

3. A method as recited in claim 1 wherein the first symbols are of a first color and the second symbols are of a second color.

4. A method as recited in claim 3 wherein the first color is darker than the second color.

5. A method as recited in claim 1 wherein the first symbols are circular in shape and the second symbols are circular in shape.

6. A method is recited in claim 1 wherein the first pattern is a grid pattern.

7. A method as recited in claim 1 wherein one or more of the first symbols are larger than the second symbols.

8. A method as recited in claim 1 wherein the first pattern is substantially the same as the second pattern.

9. A method as recited in claim 1 wherein the one or more print heads comprises a single print head that prints the first pattern and a second pattern.

10. A method as recited in claim 1 wherein the one or more print heads comprise a first print head prints the first pattern and a second print that prints the second pattern and wherein the aligned one of the one or more print heads is the second print head.

11. A method of using a test pattern for aligning one or more print heads in a print head unit, the method comprising:

printing a first pattern of first symbols on a first region of a print medium;

printing a second pattern of second symbols on the first region of the print medium in a manner to superpose the second pattern on the first pattern;

offsetting at least one of the second symbols from a corresponding first symbol in both a first offset direction and a second offset direction;

recording a first offset distance for the first offset direction and a second offset distance for the second offset direction of each offset second symbol;

designating at least one of the second symbols that is most completely obscured by a corresponding one of the first symbols; and using a first offset distance and a second offset distance corresponding to the designated second symbol as offset parameters for aligning one of the one or more print heads.

12. A method as recited in claim 11 further comprising:

printing indica to permit selection of portions of the test pattern containing at least one of the second symbols that is most completely obscured by a corresponding one of the first symbols.

13. A method as recited in claim 11 wherein the printing a second pattern of second symbols and the printing a first pattern of first symbols is performed within one print scan region.

14. A method as recited in claim 11 wherein the first symbols are of a first color and the second symbols are of a second color.

15. A method as recited in claim 14 wherein the first color is darker than the second color.

16. A method as recited in claim 11 wherein the first symbols are circular in shape and the second symbols are circular in shape.

17. A method is recited in claim 11 wherein the first pattern is a grid pattern.

18. A method as recited in claim 11 wherein one or more of the first symbols are larger than the second symbols.

19. A method as recited in claim 11 wherein the first pattern is substantially the same as the second pattern.

20. A method as recited in claim 11 wherein a print head prints the first pattern and a second pattern.

21. A method as recited in claim 11 wherein a first print head prints the first pattern and a second print head prints the second pattern.

22. A system for aligning print heads in a print head unit, the system comprising:

one or more print heads that print a first pattern of first symbols on a first region of a print medium and a second pattern of second symbols on the first region of the print medium in a manner to superpose the second pattern on the first pattern; and a controller that offsets at least one of the second symbols from a corresponding first symbol in both a first offset direction and a second offset direction, records a first offset distance and a second offset distance of each offset second symbol, designates at least one of the second symbols that is most completely obscured by a corresponding one of the first symbols, and uses the first offset distance and the second offset distance corresponding to the designated second symbol as offset parameters for aligning one of the one or more print heads.

23. A system as recited in claim 22 wherein the one or more print heads print the first pattern of first symbols and the second pattern of second symbols within one print scan region.

24. A system as recited in claim 22 wherein the first symbols are of a first color and the second symbols are of a second color.

25. A system as recited in claim 24 wherein the first color is darker than the second color.

26. A system as recited in claim 22 wherein the first symbols are circular in shape and the second symbols are circular in shape.

27. A system is recited in claim 22 wherein the first pattern is a grid pattern.

28. A system as recited in claim 22 wherein one or more of the first symbols are larger than the second symbols.

29. A system as recited in claim 22 wherein the one or more print heads comprises a single print head that prints the first pattern and a second pattern.

30. A method as recited in claim 22 wherein the one or more print heads comprise a first print head prints the first pattern and a second print head that prints the second pattern and wherein the aligned one of the one or more print head is the second print head.

* * * * *